US009322222B2

(12) United States Patent
Luppi et al.

(10) Patent No.: US 9,322,222 B2
(45) Date of Patent: Apr. 26, 2016

(54) TOWER FOR EXPLOITING FLUID IN AN EXPANSE OF WATER AND ASSOCIATED INSTALLATION METHOD

(75) Inventors: Ange Luppi, Nimes (FR); Gilles Cousin, Nimes (FR); Romain Vivet, Paris (FR); René Maloberti, Champigny sur Marne (FR)

(73) Assignee: TECHNIP FRANCE (FR)

( * ) Notice: Subject to any disclaimer, the term of this patent is extended or adjusted under 35 U.S.C. 154(b) by 0 days.

(21) Appl. No.: 13/885,330

(22) PCT Filed: Nov. 17, 2011

(86) PCT No.: PCT/FR2011/052685

§ 371 (c)(1),
(2), (4) Date: Jul. 9, 2013

(87) PCT Pub. No.: WO2012/066250

PCT Pub. Date: May 24, 2012

(65) Prior Publication Data

US 2013/0277061 A1 Oct. 24, 2013

(30) Foreign Application Priority Data

Nov. 17, 2010 (FR) ..... 10 59444

(51) Int. Cl.

| | |
|---|---|
| ***B63B 27/24*** | (2006.01) |
| ***E21B 17/01*** | (2006.01) |
| ***E21B 43/01*** | (2006.01) |

(52) U.S. Cl.

CPC ..... *E21B 17/012* (2013.01); *B63B 27/24* (2013.01); *E21B 17/015* (2013.01); *E21B 43/0107* (2013.01)

(58) Field of Classification Search

CPC ..... E21B 17/012; E21B 17/015; E21B 17/01; E21B 19/004; E21B 43/0107; E21B 43/013; E21B 33/038; E21B 7/128; E21B 19/09; F16L 1/24; F16L 1/202; B63B 21/66; B63B 35/44; B63B 21/50; B63B 21/508; B63B 22/00; B63B 35/4413; B63B 35/00

USPC ..... 166/346, 350, 352, 367; 405/158, 171, 405/172, 224.2, 224.3; 441/3, 4, 5, 133

See application file for complete search history.

(56) References Cited

U.S. PATENT DOCUMENTS 3,098,246 A * 7/1963 Pekor ..... B63B 22/021 138/114
3,111,692 A * 11/1963 Cox ..... E21B 43/01 114/264

(Continued)

*Primary Examiner* — Matthew R Buck
*Assistant Examiner* — Edwin Toledo-Duran
(74) *Attorney, Agent, or Firm* — Ostrolenk Faber LLP

(57) ABSTRACT

The present disclosure relates to a tower comprising a fluid transporting pipe (24) and an element (29) for anchoring a transporting pipe (24) to the bottom (14) of the expanse of water (12), which element is connected to an upstream point (38) of an intermediate section (30) of the pipe. The tower comprises a buoy (26) connected to a downstream point (40) of the intermediate section in order to keep the intermediate section (40) in a substantially vertical configuration. The buoy (26) has a height less than 1.5 times its maximum transverse direction and delimits a first through-passage (78A) in which the intermediate section (30) is fitted. The buoy (26) delimits a second through-passage (78B), separate from the first through-passage (78A), the second through-passage (78B) accepting the upper section (34). The tower (20) comprises a coupling section (32) that couples the connecting upper section (34) to the intermediate section (30).

17 Claims, 6 Drawing Sheets

(56) References Cited

U.S. PATENT DOCUMENTS 3,113,699 A * 12/1963 Crawford ..... B65D 88/78 137/236.1
3,189,098 A * 6/1965 Haeber ..... E21B 17/01 166/352
3,190,495 A * 6/1965 Mandel ..... B63B 22/021 222/2
3,256,937 A * 6/1966 Haeber ..... E21B 7/12 166/344
3,258,793 A * 7/1966 Schultz ..... B63B 22/021 441/5
3,307,624 A * 3/1967 Lubinski ..... E02B 17/00 166/350
3,359,741 A * 12/1967 Nelson ..... B63B 22/021 141/279
3,369,599 A * 2/1968 Evans ..... E21B 41/10 166/350
3,520,358 A * 7/1970 Brooks ..... E21B 33/076 166/356
3,750,723 A * 8/1973 Schirtzinger ..... B63B 22/023 114/230.15
3,860,983 A * 1/1975 Furth ..... B63B 22/02 114/333
3,911,688 A * 10/1975 Behar ..... B63B 22/021 114/264
RE28,978 E * 9/1976 Brooks ..... E21B 43/017 137/1
4,023,517 A * 5/1977 Ryan ..... B63B 22/021 114/230.13
4,047,579 A * 9/1977 Wilckens ..... E21B 7/128 166/345
4,098,333 A * 7/1978 Wells ..... E21B 17/012 166/352
4,258,794 A * 3/1981 Sizer ..... B63C 11/40 166/347
4,265,313 A * 5/1981 Arnaudeau ..... B63B 22/021 166/366
4,318,423 A * 3/1982 DeGraaf ..... B63B 22/021 114/230.13
4,459,066 A * 7/1984 van der Graaf ..... F16L 39/04 166/367
4,470,722 A * 9/1984 Gregory ..... E21B 43/01 166/350
4,478,586 A * 10/1984 Gentry ..... B63B 22/021 141/388
4,547,163 A * 10/1985 Langpaap ..... B63B 22/023 166/350
4,632,603 A * 12/1986 Baugh ..... E21B 17/015 166/345
4,643,614 A * 2/1987 Laursen ..... E21B 17/015 166/350
4,657,439 A * 4/1987 Petersen ..... E21B 19/006 166/341
RE32,578 E * 1/1988 Poldervaart ..... B63B 21/50 114/230.13
4,740,109 A * 4/1988 Horton ..... B63B 21/502 114/265
4,793,737 A * 12/1988 Shotbolt ..... 405/169
4,848,949 A * 7/1989 Castel ..... E21B 43/013 166/341
4,878,694 A * 11/1989 Castel ..... 285/24
5,269,629 A * 12/1993 Langner ..... F16L 27/103 166/367
5,275,510 A * 1/1994 de Baan ..... F16L 1/16 405/168.1
5,437,518 A * 8/1995 Maloberti ..... E21B 17/017 166/342
5,509,838 A * 4/1996 Breivik ..... B63B 22/026 114/230.1
5,639,187 A * 6/1997 Mungall ..... E21B 17/015 166/350
5,651,709 A * 7/1997 Nandakumar ..... B63B 22/00 114/293
5,707,174 A * 1/1998 Garren ..... E01F 5/106 294/66.1
5,716,249 A * 2/1998 Dyhrberg ..... B63B 22/025 114/230.13
5,823,131 A * 10/1998 Boatman ..... B63B 21/508 114/230.12
5,857,808 A * 1/1999 de Baan ..... B63B 21/507 114/231.12
5,941,746 A * 8/1999 Isnard ..... B63B 21/508 114/230.12
6,022,173 A * 2/2000 Saxon ..... E02F 5/08 37/337
6,082,391 A * 7/2000 Thiebaud ..... B63B 21/27 137/236.1
6,109,989 A * 8/2000 Kelm ..... B63B 22/021 405/224.2
6,206,742 B1 * 3/2001 Bull ..... B63B 22/00 405/195.1
6,230,809 B1 * 5/2001 Korsgaard ..... B63B 22/026 166/352
6,263,971 B1 * 7/2001 Giannesini ..... E21B 43/017 166/350
6,321,844 B1 * 11/2001 Thiebaud ..... B63B 21/27 137/236.1
6,386,798 B2 * 5/2002 Finn ..... E21B 19/004 166/359
6,422,316 B1 * 7/2002 Schutz ..... B63B 21/502 166/351
6,443,240 B1 * 9/2002 Scott ..... E21B 33/038 166/358
6,457,908 B1 * 10/2002 Bergeron ..... E63B 21/04 114/230.1
6,461,083 B1 * 10/2002 Pionetti ..... E21B 17/015 166/350
6,520,262 B2 * 2/2003 Barnett ..... E21B 33/076 166/339
6,558,215 B1 * 5/2003 Boatman ..... B63B 22/021 114/230.13
6,595,154 B2 * 7/2003 Boatman ..... B63B 21/508 114/230.12
6,789,981 B2 * 9/2004 Pollack ..... B63B 35/4413 166/355
6,854,930 B2 * 2/2005 Pionetti ..... E21B 17/017 166/346
7,025,533 B1 * 4/2006 Mungall ..... F16L 1/20 405/158
7,044,817 B2 * 5/2006 Bech ..... B63B 21/50 441/3
7,059,416 B2 * 6/2006 Dailey ..... E21B 17/012 166/359
7,063,485 B2 * 6/2006 Jordan ..... E21B 19/004 405/169
7,293,940 B1 * 11/2007 Perreau-Saussine E21B 17/1057 405/168.1
7,299,835 B2 * 11/2007 Dupont ..... B63B 27/24 114/230.23
7,404,695 B2 * 7/2008 Chenin ..... E21B 17/015 405/224.3
7,434,624 B2 * 10/2008 Wilson ..... E21B 17/015 166/352
7,438,617 B2 * 10/2008 Poldervaart ..... B63B 22/021 114/230.1
7,591,316 B2 * 9/2009 Hatton ..... E21B 17/015 166/350
7,654,773 B2 * 2/2010 Bastard ..... F16L 1/19 405/158
7,789,588 B2 * 9/2010 De Aquino ..... E21B 17/015 166/367
7,793,723 B2 * 9/2010 Vedeld ..... B63B 27/24 114/230.13
7,793,726 B2 * 9/2010 Daniel ..... E21B 17/01 166/350
7,798,233 B2 * 9/2010 Daniel ..... B63B 27/24 166/350
7,819,195 B2 * 10/2010 Ellis ..... E21B 19/002 166/352
8,418,766 B2 * 4/2013 Luppi ..... E21B 43/013 166/338

(56) References Cited

U.S. PATENT DOCUMENTS

2003/0170077 A1* 9/2003 Herd ..... E21B 17/015 405/224.2
2005/0063788 A1* 3/2005 Clausen ..... E21B 17/015 405/224.2
2005/0158126 A1* 7/2005 Luppi ..... B63B 21/508 405/224.2
2005/0196243 A1* 9/2005 Pollock ..... E21B 17/085 405/224.3
2009/0044950 A1* 2/2009 Boudreau ..... E21B 19/002 166/350
2010/0018717 A1* 1/2010 Espinasse ..... E21B 17/012 166/346
2011/0017465 A1* 1/2011 Wales ..... E21B 17/015 166/339
2011/0226484 A1* 9/2011 Lavagna ..... E21B 17/012 166/367
2011/0286802 A1* 11/2011 Persson ..... F16L 1/24 405/170
2012/0107050 A1* 5/2012 Wolbers ..... B63B 27/24 405/171
2012/0298373 A1* 11/2012 Luppi ..... B63B 21/507 166/350

* cited by examiner

TOWER FOR EXPLOITING FLUID IN AN EXPANSE OF WATER AND ASSOCIATED INSTALLATION METHOD

CROSS-REFERENCE TO RELATED APPLICATIONS

The present application is a 35 U.S.C. §§371 national phase conversion of PCT/FR2011/052685, filed Nov. 17, 2011, which claims priority of French Application No. 10 59444, filed Nov. 17, 2010, the contents of which are incorporated by reference herein. The PCT International Application was published in the French language.

BACKGROUND OF THE INVENTION

The present invention relates to a tower for exploiting fluid through an expanse of water, comprising:

a fluid transporting pipe, designed to be submerged in the expanse of water, the transporting pipe including a lower section designed to be connected to a bottom assembly producing fluid, a flexible upper section designed to be connected to a surface assembly, and an intermediate section placed between the upper flexible section and the lower section;

an element for anchoring the transporting pipe to the bottom of the expanse of water, connected to an upstream point of the intermediate section;

a buoy designed to be completely submerged under the surface of the expanse of water, the buoy being connected to a downstream point of the intermediate section to keep the intermediate section situated between the downstream point and the upstream point in a substantially vertical configuration under tension, the buoy having a height, considered along the vertical axis, less than 1.5 times its maximum transverse direction, the buoy delimiting a first through passage in which the intermediate section is engaged.

Such towers are designed to transport a fluid produced in the bottom of the expanse of water up to the surface, through the expanse of water. This fluid is in particular made up of liquid and/or gaseous hydrocarbons and water collected in production wells formed in the bottom of the expanse of water.

Such a tower generally has a lower connecting pipe for connecting to the production assembly positioned on the bottom of the expanse of water, a substantially vertical riser, a buoy for keeping the riser under tension in its vertical position, and an anchoring element for a lower point of the riser.

The tower further comprises an upper flexible connecting pipe connecting the riser to a floating surface assembly.

Thus, the hydrocarbons produced by the bottom assembly are successively transported through the lower connecting pipe, the riser and the upper connecting pipe as far as a surface assembly, such as a vessel, a platform or a barge, where they can be recovered or transported.

This type of tower has a relatively simple structure, since its maintenance in the vertical position is ensured exclusively by the anchoring element in the bottom of the expanse of water, and by the tension created by the buoyancy of the maintaining buoy connected to the upper point of the riser.

A tower of the aforementioned type is for example described in GB 2,024,766.

However, such towers remain difficult to install, in particular due to the depth of the expanse of water, as well as the movements on the surface of the expanse of water due to the swell and/or wind.

Furthermore, the deployment of the riser and the upper flexible pipe, and their connection on the buoy, are difficult to perform.

In particular, the upper flexible pipe is generally connected on the riser by means of a connecting section in the form of a gooseneck. This connection is done in the expanse of water after the installation and submersion of the buoy, which makes the connection operations very complex.

One aim of the invention is therefore to obtain a tower for transporting fluid through an expanse of water with a simple structure and that is easy to install, in particular at great depths or when the expanse of water is agitated.

SUMMARY OF THE INVENTION

To that end, the invention relates to a tower of the aforementioned type, characterized in that the buoy defines a second through passage, distinct from the first through passage, the second through passage receiving the upper section, the tower including a connecting section connecting the upper section to the intermediate section.

The tower according to the invention may comprise one or more of the following features, considered alone or according to any technically possible combination(s):

each through passage defines a lower opening and an upper opening, the intermediate section being engaged in the first through passage from the lower opening toward the upper opening, the upper section being engaged through the through passage from the lower opening to the upper opening, the connecting section being situated above the buoy;

the buoy has an upper surface supporting the connecting section, the connecting section advantageously being formed by a rigid pipe;

the connecting section has a first fastening means for the intermediate section emerging across from an upper opening of the first through passage, the connecting section having a second fastening means for the upper section emerging across from an upper opening of the second through passage;

the first through passage extends substantially vertically through the buoy, the second through passage extending substantially vertically through the buoy;

the first through passage extends substantially vertically through the buoy, the second through passage extending at an incline with respect to the first through passage;

the intermediate section is formed by a flexible pipe, the flexible pipe being capable of being wound and unwound reversibly without significant plastic deformation on a drum or a magazine;

the buoy has a first guide tube defining the first through passage and a second guide tube defining the second through passage, at least one of the first guide tube and the second guide tube being an I or J tube; and at least one from among the intermediate section and the upper section is provided with at least one guide member protruding radially with respect to said section to guide the movement of said section through a respective through passage;

the buoy has a substantially horizontal lower surface, a substantially horizontal upper surface, and a peripheral surface connecting the upper and lower surfaces to each other, each through passage emerging upwardly in the upper surface by means of a respective upper opening, each through passage emerging downwardly by a respective lower opening situated at the lower surface or below it.

The invention also relates to an installation method for a tower for exploiting fluid through an expanse of water, comprising the following steps:

bringing a buoy into the expanse of water, substantially across from an anchoring region on the bottom of the expanse of water;

connecting, on the buoy, a downstream point of an intermediate section of a fluid transporting pipe;

connecting, on the buoy, an upstream end of an upper flexible section of the fluid transporting pipe, designed to be connected to a surface assembly;

completely submerging the buoy under the surface of the expanse of water, before or after the connecting step of the downstream point;

anchoring an upstream point of the intermediate section on an anchoring element fixed in the bottom of the expanse of water in the anchoring region;

tensing the intermediate section of the transporting pipe between the downstream point and the upstream point under the effect of the buoyancy of the buoy, to keep the intermediate section substantially vertical in the expanse of water;

connecting, on the intermediate section, a lower section of the fluid transporting pipe designed to be connected to a bottom assembly and producing fluid;

connecting the intermediate section and the upper section by a connecting section, the buoy having a height, considered along the vertical axis, less than 1.5 times its maximum transverse direction considered transversely to the vertical axis, the step for connecting the intermediate section including engaging the intermediate section through a through passage formed through the buoy;

characterized in that the upper section is engaged through a second through passage separate from the first through passage to be connected to the intermediate section by means of the connecting section.

The method according to the invention may comprise one or more of the following features, considered alone or according to any technically possible combination(s):

the step for connecting the intermediate section and the upper section using the connecting section is done before the step for submerging the buoy under the expanse of water;

the first through passage and the second through passage each define a lower opening and an upper opening, the intermediate section being engaged in the first through passage from the lower opening toward the upper opening, the upper section being engaged in the second through passage from the lower opening toward the upper opening;

the intermediate section is flexible over substantially the entire length thereof between the downstream point and the upstream point, the intermediate section being gradually deployed in the expanse of water between the downstream point fixed on the buoy and a floating placement structure on the expanse of water during the deployment step, the intermediate section being unwound from the placement structure on which it is transported while being wound on a placement drum or on a magazine; and the method includes a step for gradual ballasting of the buoy, after the steps for connecting the intermediate section and the upper section on the connecting section to lower the upstream point toward the anchoring element, the method advantageously comprising pulling the upstream point toward the anchoring element using a pulling line engaged on the return member supported by the anchoring element.

BRIEF DESCRIPTION OF THE DRAWINGS

The invention will be better understood upon reading the following description, provided solely as an example, and done in reference to the appended drawings, in which.

DESCRIPTION OF PREFERRED EMBODIMENTS

Hereafter, the terms "upstream" and "downstream" are to be understood with respect to the normal direction of circulation of a fluid in a pipe.

Figure 1:
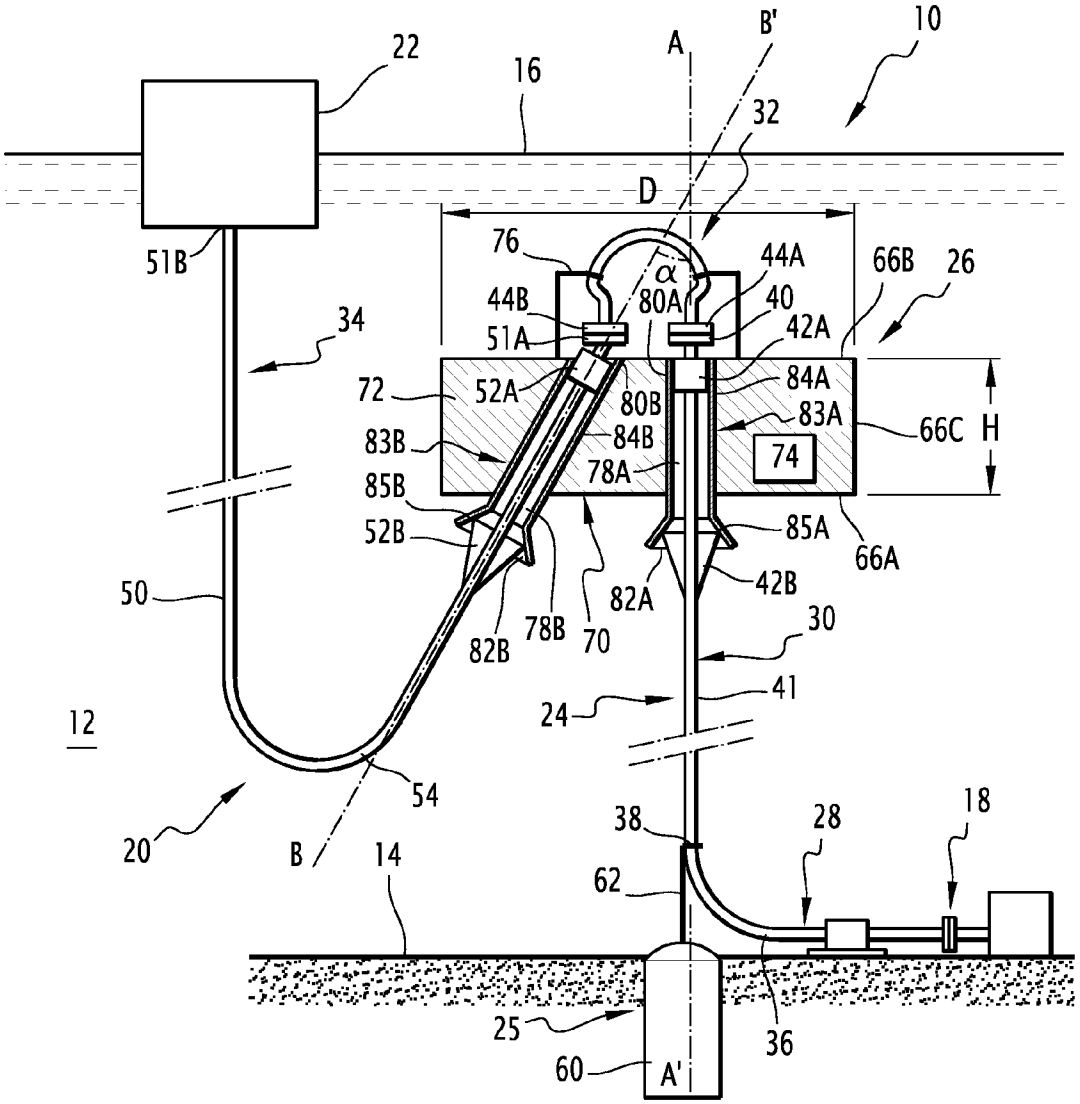
FIG. 1 is a diagrammatic, partial cross-sectional side view of a first fluid exploitation tower according to the invention positioned in an expanse of water.

A first installation 10 for exploiting fluid in an expanse of water 12, installed using a placement method according to the invention, is shown diagrammatically in FIG. 1.

This installation is designed to convey a fluid collected in the bottom 14 of the expanse of water 12 toward the surface 16 of the expanse of water.

The collected fluid is for example a gaseous or liquid hydrocarbon from a well (not shown) formed in the bottom 14 of the expanse of water.

The expanse of water 12 is a lake, a sea or an ocean. The depth of the expanse of water 12, considered between the surface 16 and the bottom 14 across from the installation 10, is greater than 30 m and is for example comprised between 30 m and 3500 m.

The installation 10 comprises a fluid production assembly 18, situated on the bottom of the expanse of water, hereafter designated using term "bottom assembly," a first tower 20 according to the invention, and a surface assembly 22, designed to recover and store the fluid collected in the production assembly 18 conveyed through the tower 20.

The bottom assembly 18 for example comprises at least one wellhead and/or production line (not shown) situated on the bottom 14 of the expanse of water.

The surface assembly 22 in this example is a floating assembly. It is for example formed by a vessel, a barge, a floating platform, or a floating hydrocarbon production, storage and offloading unit, designated using the acronym "FPSO." The surface assembly is alternatively a floating storage and regasification unit designated using the acronym "FSRU."

The surface assembly 22 floats on the expanse of water near the bottom assembly 18.

The tower 20 according to the invention comprises a fluid transporting pipe 24 connecting the bottom assembly 18 to the surface assembly 22, an anchoring element 25 of the pipe 24, fixed in an anchoring region on the bottom 14, and a buoy 26 for keeping at least one intermediate section of the transporting pipe 24 under tension in a substantially vertical configuration in the expanse of water 12.

The transporting pipe 24 comprises, from bottom to top in FIG. 1, a lower section 28 for connecting to the bottom assembly 18, an intermediate section formed by a substantially vertical riser 30, a connecting section 32 and an upper section 34 for connecting to the surface assembly 22.

In this example, the transporting pipe 24 is flexible over substantially the entire length thereof, considered between the bottom assembly 18 and the surface assembly 22, with the optional exception of the connecting section 32.

The lower section 28 is for example formed by a lower connecting hose 36 extending in a bent or inclined manner with respect to the bottom 14 of the expanse of water 12. The lower hose 36 is connected upstream of the bottom assembly 18, and is connected downstream of the riser 30.

The riser 30 extends substantially vertically along a vertical axis A-A in the expanse of water 12, between a lower upstream point 38, connected to the anchoring element 25, and an upper downstream point 40, connected to the buoy 26.

In this example, the riser 30 is formed by a flexible pipe 41 over substantially the entire length thereof.

"Flexible" or "flexible pipe" within the meaning of this invention refers to a pipe as described in the normative documents published by the American Petroleum Institute (API), API 17J and API RP17B, well known by those skilled in the art. This definition indifferently encompasses flexible pipes of the unbounded or bounded types.

More generally and alternatively, the flexible pipe 41 may be a composite bundle comprising at least one fluid transporting tube and a set of electrical or optical cables capable of transporting electrical or hydraulic power, or information, between the bottom 14 and the surface 16 of the expanse of water.

An example of a flexible pipe is described in French application FR 2,911,907.

A flexible pipe has a relatively small minimum bending radius (MBR), for example several meters, which makes it particularly capable of being wound and unwound reversibly without significant plastic deformation on a drum or magazine, the drum or magazine being supported by a lay barge, as will be seen later.

The length of the riser 30, considered between the upper point 40 and the lower point 38, is greater than 20 m and is for example comprised between 500 m and 3500 m.

The downstream point 40 of the riser 30 is advantageously provided with connecting means on the connecting section 32. These means are for example formed by a connecting flange designed to be fastened on the corresponding flange of the section 32.

The riser 30 is provided, near the downstream point 40, with a first guide member 42A of the upstream point in the buoy 26 and advantageously a first stiffener 42B designed to avoid excessive torsion of the riser 30 when it is engaged through the buoy 26.

The guide member 42A is mounted around the riser 30. It is for example formed by at least one backing fastened around the flexible pipe 41 forming the riser 30.

The stiffener 42B is releasably mounted around the flexible pipe 41 forming the riser 30. As will be seen below, it is capable of engaging on the buoy 26 and allowing sliding of the flexible pipe through the stiffener 42B.

In this example, the connecting section 32 is formed by a rigid pipe section. As will be seen below, this section 32 is supported by the buoy 26. It is generally in the shape of an upside down U or an omega. It thus has an upstream end 44A provided with upstream connecting means to the riser 30, in particular an upstream connecting flange, and a downstream end 44B provided with downstream connecting means to the upper section 34, in particular a downstream connecting flange. The ends 44A, 44B are positioned across from the buoy 26.

Alternatively, the connecting section 32 is formed by a flexible pipe as described above, for example provided with curve limiters or buoyancy elements.

In any case, the connecting element 32 is completely submerged in the expanse of water 12 under the surface 16, once the tower 20 is in place.

The upper section 34 is formed by an upper hose 50 extending between the connector 32 and the surface assembly 22.

The upper hose 50 has a catenary configuration, substantially J-shaped.

The upper hose 50 is deformable to absorb the movements of the surface assembly 22 due to the disruptions of the expanse of water such as the swell, current or wind. The section 34 thereby substantially prevents the transmission of these movements from the surface assembly 22 to the riser column 30, the downstream point 40 of which remains substantially immobile in the expanse of water.

The upper section 34 extends between an upstream end 51A fastened on the downstream end 44B of the connecting segment 32 and a downstream end 51B secured to the surface assembly 22.

At its upstream end 51A, the upper section 34 supports connecting means on the intermediate section 32 for example formed by a connecting flange.

Near the upstream end 51A, the upper section 34 is provided with a second guide member 52A and a second stiffener 52B that have structures respectively similar to the structure of the first guide member 42A and that of the first stiffener 42B.

When they are connected to each other, the lower section 28, the riser 30, the connecting section 32, and the upper section 34 inwardly define a continuous passage 54 for fluid circulation extending between the bottom assembly 18 and the surface assembly 22 to allow the fluid to be transported between said assemblies 18, 22.

In this example, the anchoring element 25 comprises an anchoring member 60 fixed in the anchoring region on the bottom 14 of the expanse of water 12 and a flexible line 62 connecting the anchoring member 60 to the upstream point 38 of the riser.

The anchoring member 60 is for example formed by a pile housed in the bottom 14 of the expanse of water or a suction anchor.

The flexible line 62 extends vertically along the axis A-A' between the anchoring element 60 and the upstream point 38.

At least during the assembly of the tower 20, the anchoring element 25 is advantageously provided with a return member 64 for a flexible pulling line. The return member 64 is for example formed by a pulley rotatably mounted on the anchoring member 60.

According to the invention, the buoy 26 has a substantially flat shape when the tower 20 is assembled in the expanse of water 12.

In this example, the buoy 26 thus has a substantially horizontal lower surface 66A, a substantially horizontal upper surface 66B and a peripheral surface 66C connecting the surfaces 66A, 66B to each other.

The buoy 26 in particular has a height H, considered along the axis A-A', less than 1.5 times its maximum transverse dimension D, considered perpendicular to the axis A-A' between the surfaces 66A, 66B.

Figure 2:
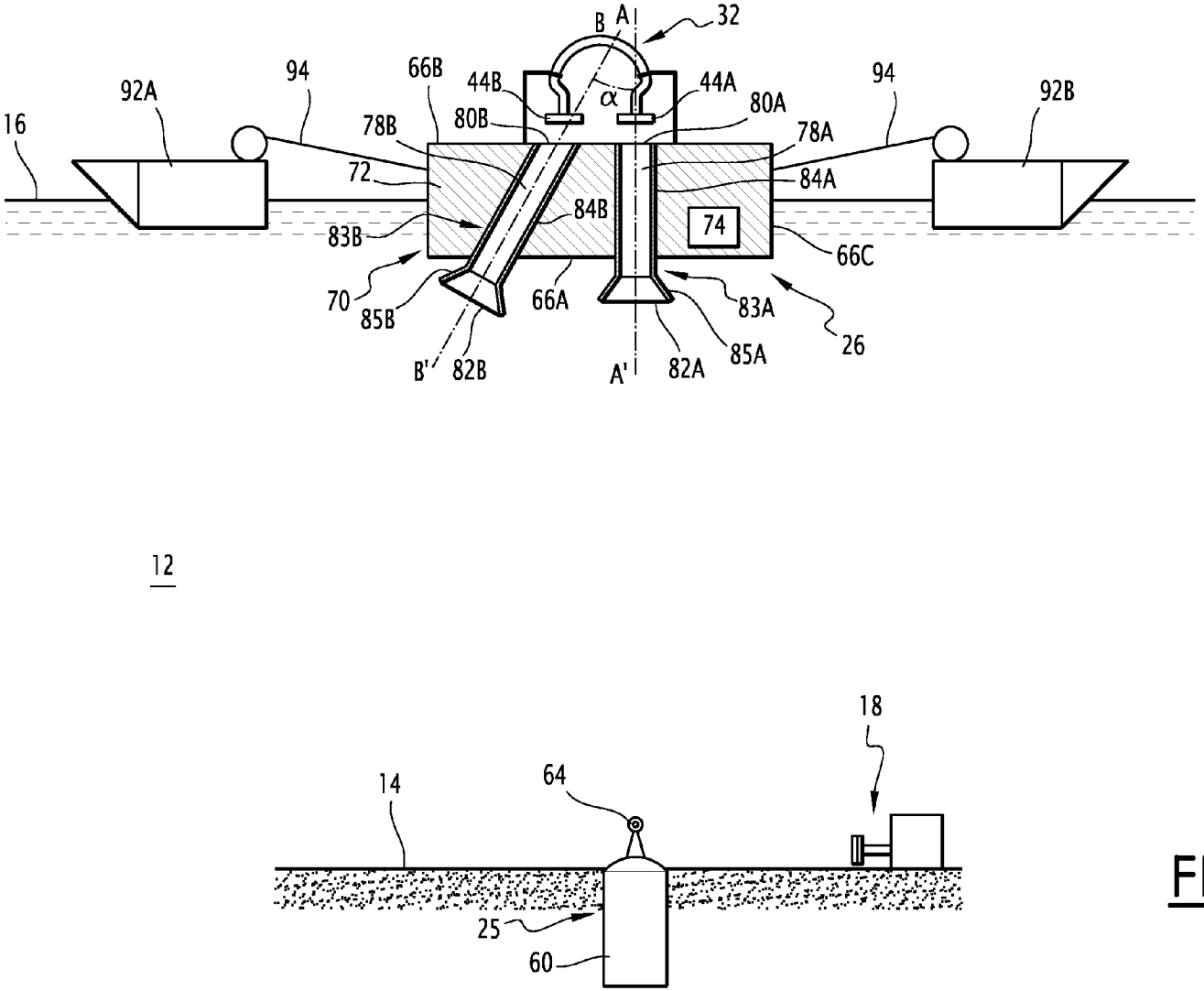
FIG. 2 is a view similar to FIG. 1, during the first step of the assembly method for the tower of FIG. 1.

As illustrated by FIG. 2, the buoy 26 advantageously has a cylindrical shape with axis A-K. The height H of the buoy is advantageously less than 1.5 times, in particular less than or equal to 1 times the maximum transverse direction of the buoy, which in this example is the diameter D of the cylinder.

The buoy 26 comprises a buoyancy caisson 70 inwardly defining at least one sealed compartment 72 that can selectively be filled with gas or liquid, and means 74 for selectively filling liquid or gas in the compartment 72.

The buoy 26 further includes, in this example, means 76 for fastening the connecting section 32 to fix the section 32 on the upper surface 66B.

In the example shown in FIGS. 1 and 2, the buoyancy caisson 70 of the buoy defines a first through passage 78A in which the riser 30 is engaged and a second through passage 78B in which the upper hose 50 is engaged.

Each passage 78A, 78B then emerges upward in the upper surface 66B by means of a respective upper opening 80A, 80B.

Each passage 78A, 78B emerges downward by a respective lower opening 82A, 82B, situated at the lower surface 66A, or below it.

The passages 82A, 82B thus pass through the caisson 70 of the buoy 26 over the entire height of the buoy 26, considered between the lower surface 66A and the upper surface 66B.

The upper opening 80A of the first passage 78A emerges across from the upstream end 44A of the connecting section 32. The upper opening 80B of the second passage 78B emerges across from the downstream end 44B of the connecting section 32.

In this example, the first passage 78A extends vertically, along the axis A-A of the riser 30, parallel to the axis of the buoy 26. The second passage 78B in this example extends along an axis B-B' that is inclined relative to the axis A-A' of the first passage 78A by an angle $\alpha$ for example comprised between 30° and 65°.

In the example illustrated in FIG. 1, the first passage 78A and the second passage 78B are respectively formed in guide tubes 83A, 83B mounted in the caisson 70.

Each tube 83A, 83B has an upper part 84A, 84B with a substantially constant cross-section, in particular complementary to the cross-section of the respective guide member 42A, 52A and a flared lower part 85A, 85B designed to receive the respective stiffener 42B, 52B.

In this example, the lower part 85A, 85B protrudes under the buoy 26 separated from the lower surface 66A.

The tubes 83A, 83B are commonly called "I tubes."

Each compartment 72 extends in the caisson 70 around the passages 78A, 78B. The filling means 74 are capable of selectively introducing gas or liquid into the or each compartment 72 to selectively increase or decrease the buoyancy of the buoy 26.

In the example illustrated in FIG. 1, the upper part of the riser 30 is engaged in the first passage 78A from bottom to top. Thus, the first stiffener 42B is received in the flared lower part 85A of the tube 83A and the first guide member 42A is received in the upper part 84A of the tube 83A.

The downstream point 40 protrudes beyond the upper surface 66B outside the first passage 78A to be connected to the upstream end 44A.

Likewise, the upstream part of the hose 50 is engaged from bottom to top in the second passage 78B. To that end, the second stiffener 52B is received in the flared lower part 85B of the tube 83B. The second guide member 52A is received in a complementary manner in the upper part 84B of the tube 83B. The upstream end 51A of the hose 50 protrudes beyond the upper surface 66B outside the second passage 78B to be connected on the downstream end 44B of the connecting section 32.

Thus, the riser 30 passes through the buoy 26 from bottom to top between the lower opening 82A and the upper opening 80A of the first passage 78A and the hose 50 passes through the buoy 26 from bottom to top between the lower opening 82B and the upper opening 80B of the second passage 78B.

The riser 30 has a substantially vertical configuration along the axis A-A. The connecting section 32 has a U-shaped configuration oriented downward. The upper section 34 has a configuration in the form of a small chain or an upwardly-oriented U.

A first method for placing the installation 10 according to the invention will now be described, in light of FIGS. 2 to 5.

This method is implemented using a lay barge 90 for the transporting pipe 24, and using at least one vessel 92A, 92B for towing the buoy 46, separate from the lay barge 90. In the example illustrated in FIG. 2, the method is implemented using two towing vessels 92A, 92B.

Initially, the pipe elements 36, 42 designed to form the transporting pipe 24 are brought near the bottom assembly 18 using the lay barge 90 and the pipe element 50 is brought under the surface assembly 22.

To that end, the lower hose 36 and the flexible pipe 41 are transported by the lay barge 90 while for example being wound on the placement drum or in a magazine.

The anchor element 25 is installed in the bottom 16 of the expanse of water 12 near the bottom assembly 18. To that end, the anchoring member 60 is fixed in the bottom 14 of the expanse of water 12.

According to the invention, the buoy 26 is towed while being partially submerged, with its upper surface 66B situated outside the expanse of water 12 and its lower surface 66A submerged, between a position separated from the anchoring element 25 and a position placed substantially across from and above the anchoring element 25.

During this transport, the buoy 26 extends substantially horizontally with its axis A-A' vertical.

The buoy 26 has a substantially flat shape, and it is not very sensitive to movements of the surface 16 of the expanse of water 12, and in particular the swell, currents or wind, such that it can be transported safely while being only partially submerged in the expanse of water 12, using towing vessels 92A, 92B. It is also a work station owing to its large flat upper surface 66B.

The towing distance of the buoy 26, which horizontally separates the separated position from the placement position, is greater than several hundred meters, or even several hundred kilometers.

In one alternative, the buoy 26 is onboard a partially submersible barge, then is submerged in the water by submerging the barge, before being towed.

Then, when the buoy 26 is in its placement position shown in FIG. 2, it is kept in a horizontal position by the towing vessels 92A, 92B using deployable mooring lines 94.

A pulling vehicle 96 is then mounted on the buoy 26, for example on the upper surface 66B thereof. Said towing vehicle 96 for example comprises a winch 96 provided with a deployable pulling line 98.

Figure 3:
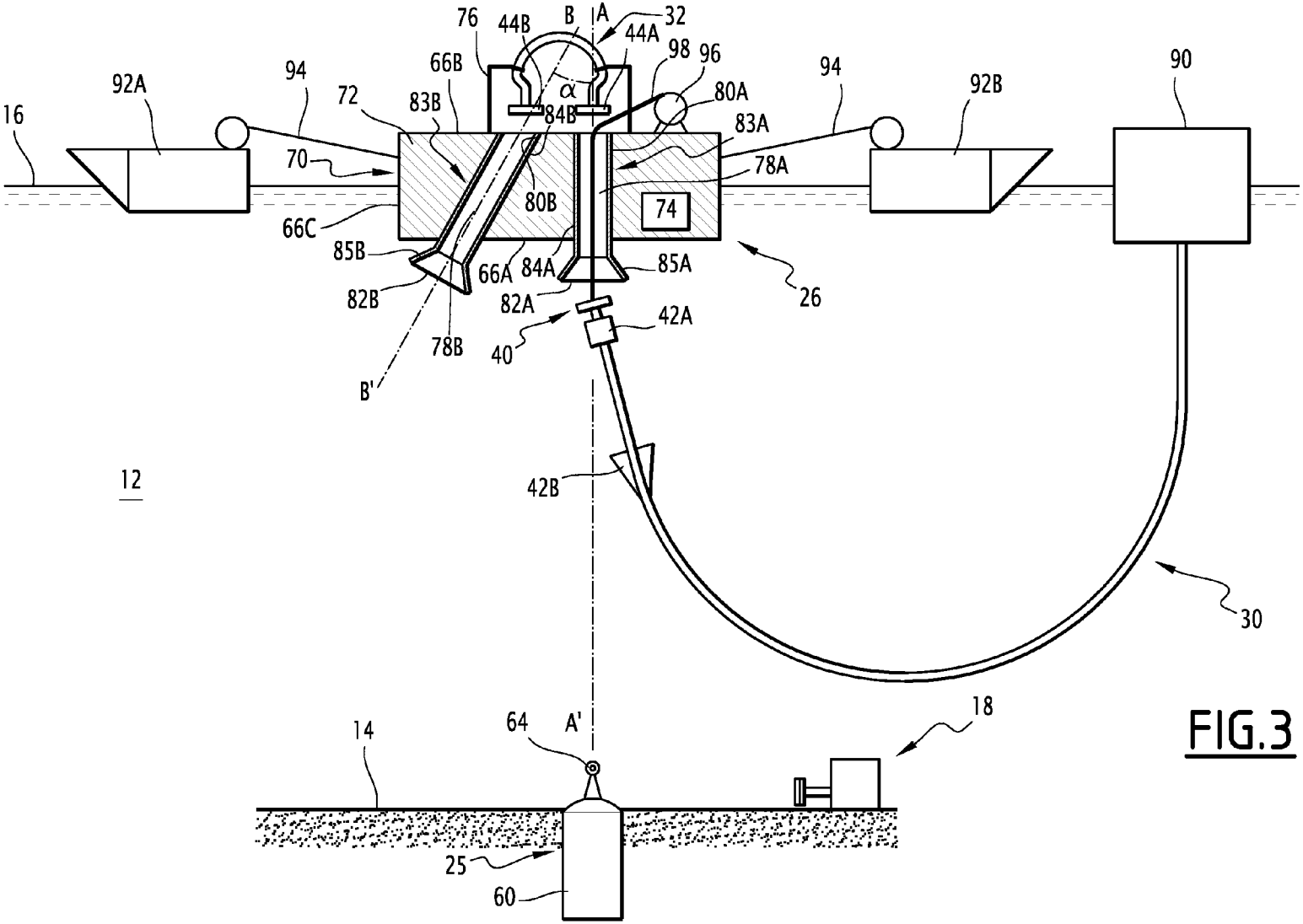
FIG. 3 is a view similar to FIG. 2 of the second step of the method for assembling the tower of FIG. 1.

In reference to FIG. 3, the distance separating the lay barge 90 from the buoy 26 being relatively significant, for example greater than 50 m, the curve radius of the flexible pipe 41 in that configuration is high to prevent any damage to the flexible pipe 41.

Furthermore, the weight of the flexible pipe 41 being distributed between the lay barge 90 and the buoy 26, it is not necessary to equip the buoy 26, or the lay barge 90, with a high-capacity winch 96.

The pulling of the line 98 toward the winch 96 continues until the downstream point 40, the first guide member 40A and the first stiffener 42B are successively inserted in the first passage 78A from bottom to top.

The stiffener 42B then becomes wedged in the lower part 85A of the tube 83A.

Then, the stiffener 42B is freed from the flexible pipe 30. The raising of the downstream point 40 continues by sliding of the flexible pipe 30 in the stiffener 42B.

The guide member 42A and the downstream point 40 therefore rise along the first passage 78A from the lower opening 82A to the upper opening 80A of the first passage, before the downstream point 40 is removed outside the first passage 78A through the upper opening 80A.

The downstream point 40 is then fastened on the upstream end of the connecting section 32, either by screwing and/or bolting flanges to each other, or by positioning a tightening collar around the flanges.

The pulling line 98 is then disconnected from the downstream point 40. The winch 96 is then moved in the vicinity of the upper opening 80B of the second passage 78B. Alternatively, another winch 96 is present near the second passage 78B.

Figure 4:
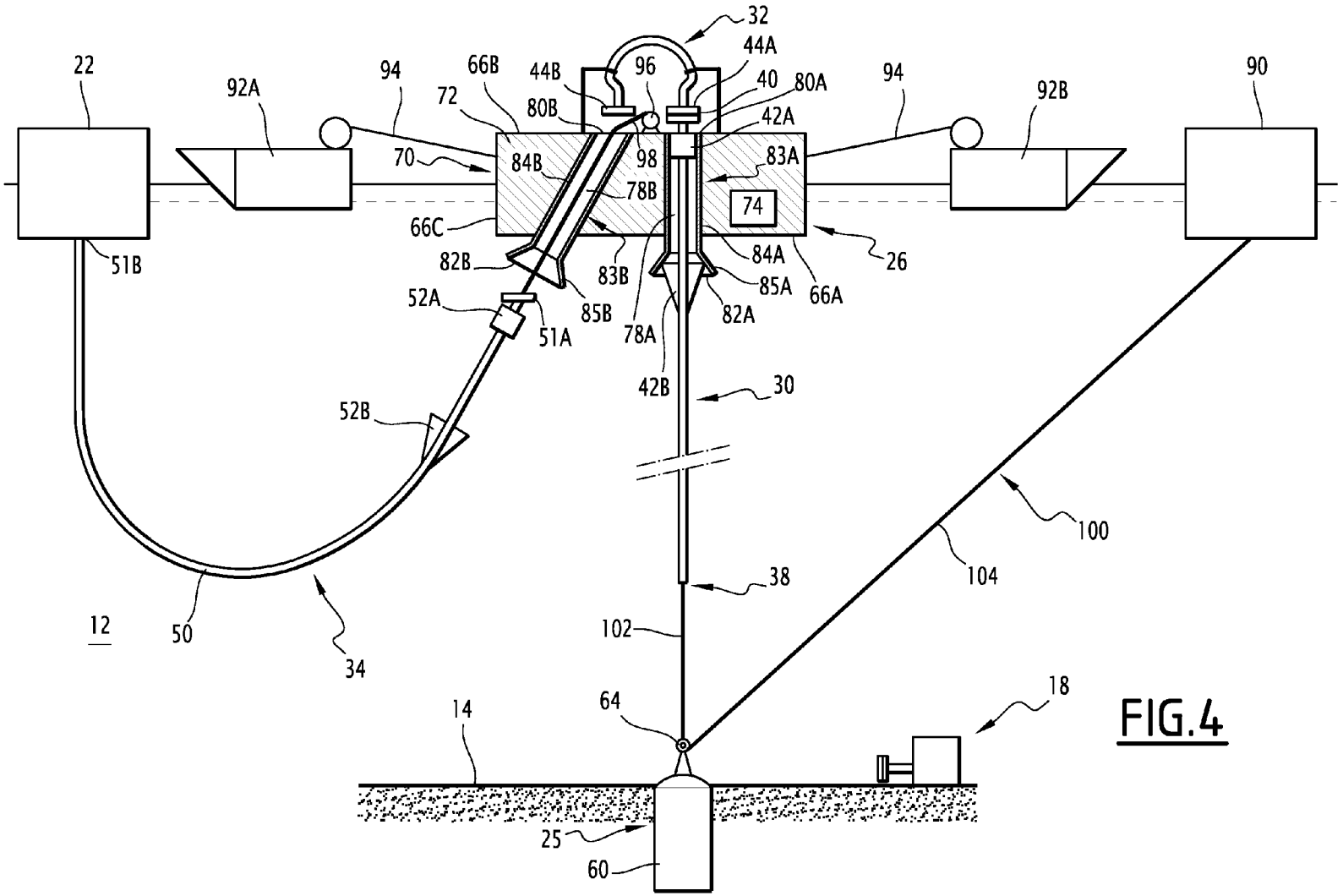
FIG. 4 is a view similar to FIG. 2 of a third step of the assembly method of FIG. 1.
Figure 5:
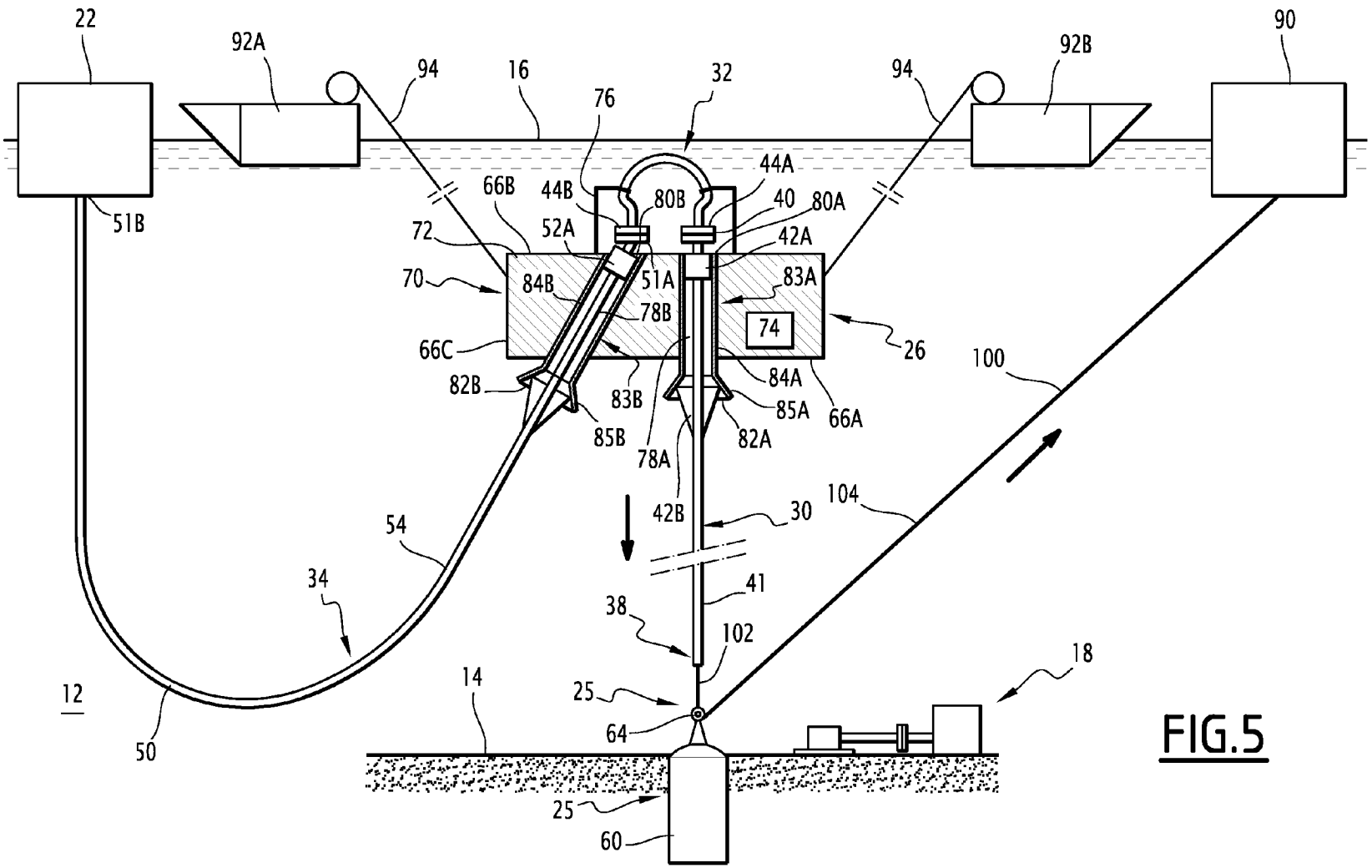
FIG. 5 is a view similar to FIG. 2 of a fourth step of the assembly method.

Then, as illustrated by FIG. 4, the line 98 is engaged through the second passage 78B, then is fastened on the upstream end 51A of the upper hose 50.

The winch 96 is then activated to bring the downstream end 51A of the buoy 26 closer, by retracting an increasing length of the line 98 on the winch 96. Simultaneously, an increasing length of the upper hose 50 is deployed outside the surface assembly 22. The hose 50 adopts a substantially catenary or U shape between the surface assembly 22 and the buoy 26.

As previously described, the pulling of the line 98 continues until the upstream end 51A, the second guide member 52A and the second stiffener 52B enter the second passage 78B through the lower opening 82B.

When the stiffener 52B is wedged in the lower part 85B of the tube 83B, the upper hose 50 is released with respect to the stiffener 52B to slide through the stiffener 52B. The end 51A and the guide member 52A rise through the second passage 78B.

This movement continues until the downstream end 51A is extracted outside the second passage 78B through the upper opening 80B to be connected on the downstream end 44B of the connecting section 32.

The ends 44B, 51A are then fastened on one another for example by screwing and/or bolting the flanges to each other, or by placing a tightening collar.

The sealing of the passage 54 between the upper section 34 and the connecting section 32 on the one hand, and between the connecting section 32 and the intermediate section 30 on the other hand, is then verified.

It should be noted that the connection of the hose 50 on the section 32 is done directly on the buoy 26, benefiting from the work surface offered by the upper surface 66B of the buoy 26.

In light of its dimensions, the buoy 26 is also extremely stable, which makes the operations done on the buoy 26 very safe.

All of the connecting steps being carried out above the surface 16 of the expanse of water 12 on the surface, the assembly of the tower 20 is therefore very simple to carry out. Furthermore, the sealing of the connection may be tested on the surface, before submerging the buoy 26, which does not require raising the buoy 26 when the sealing is not suitable.

The pulling line 98 is then disconnected from the downstream end 51A and the winch 96 is advantageously disassembled away from the buoy 26.

Then, the upstream point 38 is fastened on the anchoring element 25, for example using a method of the type described in patent application WO 2009/118467 by the Applicant.

To that end, the upstream point 38 is lowered into the expanse of water 12 until the intermediate section 30 is in a substantially vertical configuration.

Then, as illustrated by FIG. 4, the upstream point 38 is connected to a pulling line 100 deployed from the lay barge 90. The pulling line 100 is engaged around the return member 64. It thus has a first vertical section 102 extending between the upstream point 38 and the return element 64 and a second inclined section 104 extending between the return element 64 and the lay barge 90.

Then, the mooring lines 94 are relaxed and the filling means 74 are activated to introduce liquid into the compartments 72 so as to decrease the buoyancy of the buoy 26.

Simultaneously, the pulling line 100 is retracted into the lay barge 90 to pull the downstream point 38 toward the anchoring member 60 and thereby guide the positioning of the riser 30 toward the anchoring element 25.

The buoy 26 is then lowered and is completely submerged in the expanse of water 12 at a depth greater than several tens of meters, in a region of the expanse of water 12 that is not affected by the swell and waves. The buoy 26 preserves its horizontal orientation during lowering, with its axis A-A' substantially vertical along its height.

When the upstream point 38 is situated near the anchoring element 60, the flexible anchoring line 62 is then attached on the upstream point 38 and on the anchoring element 60. Then, the lower hose 36 is lowered from the lay barge 90 to be connected on the one hand to the upstream point 38, and on the other hand to the bottom assembly 18.

Then, the buoyancy of the buoy 26 is optionally modified to apply, between the downstream point 40 and the upstream point 38, by means of the buoy 26, an upwardly-oriented pulling force, said force being compensated by the retaining force provided by the anchoring line 62. The riser 30 then extends vertically along the axis A-A between its upstream point 38 and its downstream point 40.

In this configuration, the continuous hydrocarbon circulation passage 54 between the bottom assembly 18 and the surface assembly 22 is established successively through the lower section 28, the riser 30, the connecting section 32 and the upper section 34. The fluid collected by the bottom assembly 18 is then transported to the surface assembly 22 through the passage 52.

Figure 6:
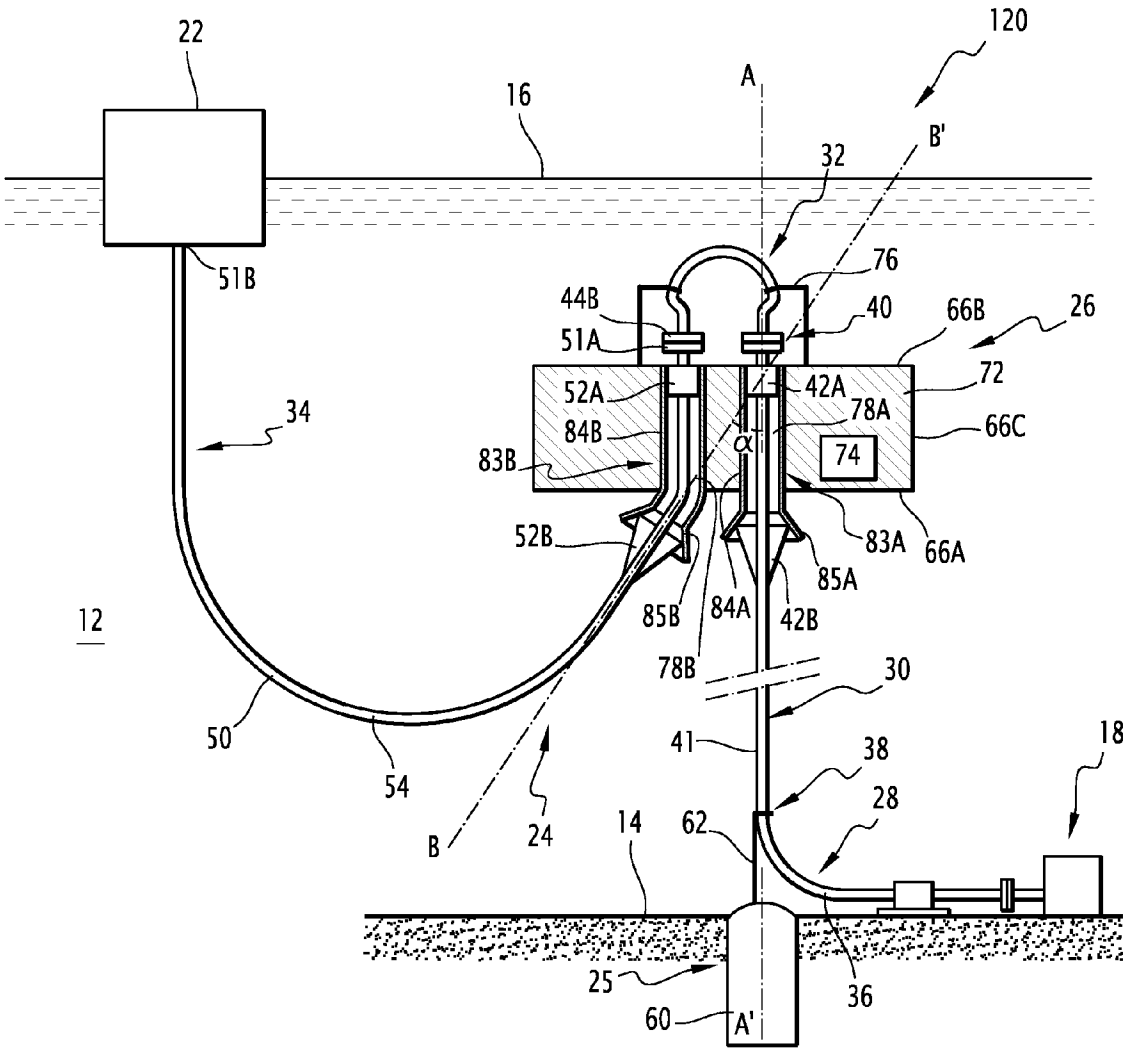
FIG. 6 is a view similar to FIG. 1 of a second fluid exploitation tower according to the invention.

A second installation 120 according to the invention is shown in FIG. 6. Unlike the tower 20 of the first installation 10, the tower 20 of the second installation 120 includes a buoy 26 but has a second substantially vertical passage 78B through the buoy 26.

Thus, the second passage 78 is advantageously defined by a "J tube" 83A.

The tube 83B thus includes an upper part 84B substantially parallel to the axis A-A' of the first passage 78A and a lower part 85B with an axis that is inclined with respect to the upper part 84B, in particular by an angle $\alpha$ comprised between 30° and 65°.

The inclined lower part 85B protrudes downward from the lower surface 66A of the buoy 26.

The tower 20 of the second installation 120 is otherwise identical to the tower 20 of the first installation 10.

The method for placing the tower 20 shown in FIG. 6 is similar to the method for placing the tower 20 shown in FIG. 1.

In one alternative, the intermediate section 30 does not have a stiffener 42B and guide member 42A, and the upper section 34 does not have a stiffener 52B and guide member 52A.

In another alternative, during placement of the tower 20, the buoy 26 is submerged in the expanse of water 12 while maintaining the U configuration of the intermediate section 30, between the lay barge 90 and the buoy 26.

Then, the downstream point 38 is moved under the buoy 26 by means of a deployment line (not shown), after submersion of the buoy.

What is claimed is:

1. A tower for exploiting fluid through an expanse of water, comprising:

a fluid transporting pipe, designed to be submerged in the expanse of water, the fluid transporting pipe including a lower section designed to be connected to a bottom assembly producing fluid, a flexible upper section designed to be connected to a surface assembly, and an intermediate section placed between the flexible upper section and the lower section;

an element for anchoring the fluid transporting pipe to the bottom of the expanse of water, connected to an upstream point of the intermediate section;

a buoy designed to be completely submerged under the surface of the expanse of water and having an upper surface, a lower surface, and a peripheral surface connecting the upper surface and the lower surface, the buoy being connected to a downstream point of the intermediate section to keep the intermediate section situated between the downstream point and the upstream point in a substantially vertical configuration under tension, the buoy having a height, considered along a vertical axis, less than 1.5 times a maximum transverse direction of the buoy, a first through passage extending from the lower surface to the upper surface of the buoy in which the intermediate section is engaged, a second through passage extending from the lower surface to the upper surface of the buoy, distinct from the first through passage, the second through passage receiving the flexible upper section, the tower including a connecting section connecting the upper section to the intermediate section, wherein the height of the buoy is less than 1.5 times of the maximum transverse direction of the buoy when the intermediate section of the transporting pipe is inserted in the first through passage and when the flexible upper section of the transporting pipe is inserted in the second through passage, wherein the buoy comprises a buoyancy caisson defining at least one sealed compartment which can be selectively filled with gas or liquid, and further comprising a device to selectively fill the compartment with gas or liquid, the first through passage and the second through passage passing through the caisson of the buoy, wherein the flexible upper section designed to be connected to a surface assembly passes through the caisson of the buoy from the lower surface to the upper surface in the second through passage.

2. The tower according to claim 1, wherein each through passage defines a lower opening and an upper opening, the intermediate section being engaged in the first through passage from the lower opening toward the upper opening, the flexible upper section being engaged through the second through passage from the lower opening to the upper opening, the connecting section being situated above the buoy.

3. The tower according to claim 1, wherein the buoy has an upper surface supporting the connecting section, the connecting section advantageously being formed by a rigid pipe.

4. The tower according to claim 1, wherein the connecting section has a first fastening means for the intermediate section emerging across from an upper opening of the first through passage, the connecting section having a second fastening means for the flexible upper section emerging across from an upper opening of the second through passage.

5. The tower according to claim 1, wherein the first through passage extends substantially vertically through the buoy, the second through passage extending substantially vertically through the buoy.

6. The tower according to claim 1, wherein the first through passage extends substantially vertically through the buoy, the second through passage extending at an incline with respect to the first through passage.

7. The tower according to claim 1, wherein the intermediate section is formed by a flexible pipe, the flexible pipe being capable of being wound and unwound reversibly without significant plastic deformation on a drum or a magazine.

8. The tower according to claim 1, wherein the buoy has a first guide tube defining the first through passage and a second guide tube defining the second through passage, at least one of the first guide tube and the second guide tube being an I or J tube.

9. The tower according to claim 1, wherein at least one from among the intermediate section and the flexible upper section is provided with at least one radially protruding guide member for guiding through a respective through passage.

10. The tower according to claim 1, wherein the first through passage and the second through passage are delimited by guide tubes, each compartment extending in the caisson around the first through passage and the second through passage.

11. The tower according to claim 1 further comprising, a first stiffener slidably mounted around the flexible upper section;

a second stiffener slidably mounted around the intermediate section;

a first guide tube extending from the lower surface to the upper surface of the buoy and defining the first through passage, and a second guide tube extending from the lower surface to the upper surface of the buoy and defining the second through passage, wherein the first guide tube includes an upper part with a constant cross-section and a flared lower part, and the second guide tube has an upper part with a constant cross-section and a flared lower part, the flared lower parts being located below the upper surface and being configured to intercept the stiffeners.

12. An installation method for a tower for exploiting fluid through an expanse of water, comprising the following steps:

bringing a buoy into the expanse of water, substantially across from an anchoring region on the bottom of the expanse of water, the buoy having an upper surface, a lower surface, and a peripheral surface connecting the upper surface and the lower surface;

connecting, on the buoy, a downstream point of an intermediate section of a fluid transporting pipe;

connecting, on the buoy, an upstream end of an upper flexible section of the fluid transporting pipe, designed to be connected to a surface assembly;

completely submerging the buoy under the surface of the expanse of water, before or after the connecting step of the downstream point;

anchoring an upstream point of the intermediate section on an anchoring element fixed in the bottom of the expanse of water in the anchoring region;

tensing the intermediate section of the fluid transporting pipe between the downstream point and the upstream point under the effect of the buoyancy of the buoy, to keep the intermediate section substantially vertical in the expanse of water;

connecting, on the intermediate section, a lower section of the fluid transporting pipe designed to be connected to a bottom assembly and producing fluid;

connecting the intermediate section and the upper flexible section by a connecting section, the buoy having a height, considered along the vertical axis, less than 1.5 times a maximum transverse direction of the buoy considered transversely to the vertical axis, the step for connecting the intermediate section including engaging the intermediate section through a first through passage formed through the buoy, and extending from the lower surface to the upper surface of the buoy;

wherein the upper flexible section is engaged through a second through passage separate from the first through passage to be connected to the intermediate section by means of the connecting section, the second through passage extending from the lower surface to the upper surface of the buoy, and wherein the height of the buoy is less than 1.5 times of the maximum transverse direction of the buoy when the intermediate section of the transporting pipe is inserted in the first through passage and when the flexible upper section of the transporting pipe is inserted in the second through passage, wherein the buoy comprises a buoyancy caisson defining at least one sealed compartment which can be selectively filled with gas or liquid, and further comprising a filling device to selectively fill the compartment with gas or liquid, the first through passage and the second through passage passing through the caisson of the buoy, and wherein the flexible upper section designed to be connected to a surface assembly passes through the caisson of the buoy from the lower surface to the upper surface in the second through passage.

13. The method according to claim 12, wherein the step for connecting the intermediate section and the upper flexible section using the connecting section is done before the step for submerging the buoy under the expanse of water.

14. The method according to claim 12, wherein the first through passage and the second through passage each define a lower opening and an upper opening, the intermediate section being engaged in the first through passage from the lower opening toward the upper opening, the upper flexible section being engaged in the second through passage from the lower opening toward the upper opening.

15. The method according to claim 12, wherein the intermediate section is flexible over substantially the entire length thereof between the downstream point and the upstream point, the intermediate section being gradually deployed in the expanse of water between the downstream point fixed on the buoy and a floating placement structure on the expanse of water during the deployment step, the intermediate section being unwound from the floating placement structure on which it is transported while being wound on a placement drum or on a magazine.

16. The method according to claim 12, wherein it includes a step for gradual ballasting of the buoy, after the steps for connecting the intermediate section and the upper flexible section on the connecting section to lower the upstream point toward the anchoring element, the method advantageously comprising pulling the upstream point toward the anchoring element using a pulling line engaged on a return member supported by the anchoring element.

17. The method according to claim 12, further comprising towing the buoy while the buoy is partially submerged and upper surface of the buoy is outside the expanse of water and a lower surface of the buoy is submerged, between a position separated from the anchoring element, and a position placed substantially across from and above the anchoring element the buoy extending substantially horizontally with its axis vertical, the buoy being lowered and completely submerged in the expanse of water by preserving the buoy's horizontal orientation during lowering through activation of the filling device.

* * * * *